US008076599B2

(12) United States Patent
Mora

(10) Patent No.: US 8,076,599 B2
(45) Date of Patent: Dec. 13, 2011

(54) FOOT ACTUATED SWITCH

(76) Inventor: Assad F. Mora, Santa Barbara, CA (US)

( * ) Notice: Subject to any disclaimer, the term of this patent is extended or adjusted under 35 U.S.C. 154(b) by 273 days.

(21) Appl. No.: 12/557,228

(22) Filed: Sep. 10, 2009

(65) Prior Publication Data

US 2010/0092914 A1 Apr. 15, 2010

Related U.S. Application Data

(60) Provisional application No. 61/095,858, filed on Sep. 10, 2008.

(51) Int. Cl.
*H01H 3/14* (2006.01)

(52) U.S. Cl. ..... 200/86.5

(58) Field of Classification Search ..... 200/86.5; 606/1, 32, 34, 41, 42, 166, 167, 126, 118, 606/170; 307/119; 74/512, 560–562; 433/98, 433/101, 113; 378/114, 115; 5/613, 616
See application file for complete search history.

(56) References Cited

U.S. PATENT DOCUMENTS

| | | | | |
|---|---|---|---|---|
| 2,872,542 | A * | 2/1959 | Thompson | 200/86.5 |
| 3,963,890 | A | 6/1976 | Straihammer | |
| 5,051,797 | A * | 9/1991 | Erhardt | 257/230 |
| 5,422,521 | A * | 6/1995 | Neer et al. | 307/119 |
| 5,535,642 | A | 7/1996 | Moll | |
| 6,360,630 | B2 * | 3/2002 | Holtorf | 74/512 |
| 6,368,269 | B1 * | 4/2002 | Lane | 600/126 |
| 6,608,267 | B2 * | 8/2003 | Fischer et al. | 200/86.5 |
| 6,689,975 | B2 * | 2/2004 | Metzler et al. | 200/86.5 |
| 7,012,203 | B2 * | 3/2006 | Hanson et al. | 200/86.5 |
| 7,193,169 | B2 * | 3/2007 | Mezhinsky et al. | 200/200 |
| 7,381,917 | B2 * | 6/2008 | Dacquay et al. | 200/86.5 |
| 7,557,317 | B2 * | 7/2009 | Blaha et al. | 200/86.5 |
| 7,619,171 | B2 * | 11/2009 | Horvath et al. | 200/86.5 |
| 7,626,132 | B2 * | 12/2009 | Mezhinsky | 200/86.5 |

FOREIGN PATENT DOCUMENTS

| | | | |
|---|---|---|---|
| JP | 5-076680 | A | 3/1993 |
| JP | 11-203978 | A | 7/1999 |
| JP | 2003-331680 | A | 11/2003 |
| KR | 20-0365663 | Y1 | 10/2004 |

OTHER PUBLICATIONS

International Search Report and Written Opinion mailed Mar. 31, 2010 in related International Application No. PCT/US2009/056523.

* cited by examiner

*Primary Examiner* — Michael Friedhofer
(74) *Attorney, Agent, or Firm* — Baker & Daniels LLP

(57) ABSTRACT

The present invention provides a foot control unit having a plurality of switches for use by a dentist, surgeon, or other professional that is ergonomically designed to minimize body movement during activation and to prevent interruptions of the procedure being performed that may be caused by the same. In one exemplary embodiment, the design provides for the operator's, e.g., the dentist's, foot to be continuously and comfortably supported in a neutral muscular-skeletal position by a portion of the foot control unit both at rest and during activation. By providing the foot with a neutral muscular-skeletal position at rest, the position of each of the switches may be kept at a substantially minimal and substantially equal distance from a corresponding activating part of the foot. This allows for the foot control unit of the present invention to minimize muscular activities and movement during activation.

20 Claims, 5 Drawing Sheets

FOOT ACTUATED SWITCH

CROSS-REFERENCE TO RELATED APPLICATIONS

This application claims the benefit under Title 35 U.S.C. §119(e) of U.S. Provisional Patent Application Ser. No. 61/095,858, entitled FOOT ACTIVATED SWITCH, filed on Sep. 10, 2008, the entire disclosure of which is expressly incorporated by reference herein.

BACKGROUND

1. Field of the Invention

The present invention relates to switches, and, particularly, to foot actuated switches.

2. Description of the Related Art

During a dental procedure, a dentist's hands are positioned in or around a patient's oral cavity. For example, the dentist's hands may grasp a dental mirror, dental drill, suction tube, or other dental instrument in order to use the same during the procedure. As a result, the dentist's hands are unavailable to activate the dental instruments or otherwise operate the same. For example, if a dental procedure requires the use of a dental microscope, the dentist may lack a free hand to adjust the focus and/or zoom of the microscope. Moreover, the number of dental instruments that must be used during a dental procedure often require that a dental assistant, who is present during the dental procedure, also holds or otherwise manipulates additional dental instruments.

In order to provide the dentist with an effective way to activate and control a dental instrument when the dentist's hands are unavailable, foot switches have been used. Commonly, these foot switches are formed as an inclined plate with a flat base. The heel of the dentist's foot is placed on the floor and/or the flat base and the toes are lifted above the heel to activate the foot switch. In some embodiments, the inclined plate itself functions as a first switch and additional switches are placed upon the face of the inclined plane. Thus, by depressing one of the switches on the inclined plate, a first function is achieved. Similarly, by depressing the inclined plate itself, a second function may be achieved.

For example, foot switches may be used in conjunction with a microscope to control the zoom of the microscope, as working under microscope magnification is restrictive in many ways. Specifically, under microscope magnification, the depth of field is very shallow and gets shallower as the magnification level is increased. In order to keep a point of interest in focus and maintain a sharp view of a non-stationary three-dimensional operating field having several inclined planes, the microscope must be focused constantly. Otherwise, the operator would have to work in a field that is not in sharp focus until the operator can no longer readily differentiate objects in the operating field. At that point the operator is forced to interrupt the procedure to manually refocus the microscope. With a foot switch controlling a motorized focusing function of the microscope, the operator can maintain sharp focus during the procedure with decreased interruption. Maintaining visual acuity during an operation improves the efficiency of and maintains a higher level of accuracy for a procedure. Further, controlling the zoom function of the microscope with a foot switch allows the operator to either expand the size of the operating field, which may be necessary when an instrument is approaching the edge of the field, or zoom in to see more details with a decreased amount of interruption to the procedure.

While known foot switches are effective, several drawbacks remain. Specifically, because the inclined plate is itself a switch, the dentist's foot must be entirely removed from the inclined plate when it is not being depressed to prevent the dentist from unintentionally altering the function of a dental instrument. As a result, when the dentist attempts to depress any of the switches on the inclined plate, the dentist may need to make visual contact with the inclined plate in order to realign the dentist's foot with the switch. However, making visual contact may be difficult, as the inclined plate is often positioned beneath the patient's head and/or body when the patient is in a reclined position during a dental procedure. Thus, the dentist may need to bend, twist, or otherwise substantially move their upper body to make visual contact with the switch. This results in the dentist having to remove the dental instrument from the patient's oral cavity and stop the progress of the dental procedure in order for the dentist to make visual contact with the inclined plate and to realign the dentist's foot with the switch.

Additionally, since there is nothing that facilitates the retention of the inclined plate and base in position, the inclined plate and base may move as a result of a switch being depressed. Thus, over the course of a dental procedure, the inclined plate and base may move a substantial distance. As a result of this movement, the dentist may again need to make visual contact with the inclined plate in order to realign the dentist's foot with the switch. However, for the same reasons identified above, this causes the dentist to pause or otherwise stop the dental procedure.

Further, if the dentist attempts to keep their foot in position and lifted from the inclined plate of the switch, the dentist is forced to hold their foot in an unnatural position in which the ball and toes of the foot are elevated relative to the heel of the foot. For example, the dentist may maintain the heel on the floor adjacent to the inclined plate with the ball and toes of the foot elevated above the heel and the inclined plate. However, maintaining the foot in this type of position may result in substantial stress and fatigue on the dentist's ankle and/or foot. Moreover, when the dentist attempts to control multiple functions of a piece of dental equipment with a single foot control unit, e.g., an inclined plate that includes multiple switches, the dentist may have to move the dentist's foot between multiple positions to align the foot with the different switches. This gross movement of the dentist's foot may be transmitted through the body and into the hand of the dentist that is holding the dental instrument. Any uncontrolled movements of the body and/or the hands of a dentist during a dental procedure, particularly when being viewed under microscope magnification, may cause an unwanted interruption of the dental procedure.

SUMMARY

The present invention provides a foot control unit having a plurality of switches for use by a dentist, surgeon, or other professional that is ergonomically designed to minimize body movement during activation and to prevent interruptions of the procedure being performed that may be caused by the same. In one exemplary embodiment, the design provides for the operator's, e.g., the dentist's, foot to be continuously and comfortably supported in a neutral muscular-skeletal position by a portion of the foot control unit both at rest and during activation. By providing the foot with a neutral muscular-skeletal position at rest, the position of each of the switches may be kept at a substantially minimal and substantially equal distance from a corresponding activating part of the foot. This allows for the foot control unit of the present invention to minimize muscular activities and movement during activation.

In one exemplary embodiment, the foot control unit of the present invention includes a base plate, a rear heel support extending upwardly from a base plate, and a pair of switches positioned on the base plate. The rear heel support provides an area upon which the heel of the dentist's foot may rest during a dental procedure. In one exemplary embodiment, the heel support is elevated relative to switches mounted on the base plate, which allows the dentist's foot to hang from the heel support with the toes positioned below the heel, i.e., below the top surface of the heel support upon which the heel of the dentist is supported. Additionally, the heel support may also facilitate positioning the dentist's foot with a lateral side of the dentist's foot positioned closer to the base plate and the medial side of the dentist's foot positioned further from the base plate. Stated another way, the lateral side of the dentist's foot is positioned closer to the ground on which the base plate is supported and the medial side of the patient's foot is positioned further from the ground on which the base plate is supported.

With the dentist's foot supported on the heel support of the foot control unit of the present invention in the manner described above, a first, acute angle is formed between the floor on which the base plate is supported and the longitudinal axis of the sole of the dentist's foot. Additionally, as a result of the lateral side of the dentist's foot being lower that its medial counterpart, a second angle is formed with the floor on which the base plate is supported and the sole of the dentist's foot in a direction perpendicular to the longitudinal axis of the dentist's foot. By allowing the dentist's foot to rest on the heel support in the position described above, the dentist's foot is maintained in a neutral muscular-skeletal position, which eliminates the stress and fatigue that may be experienced when using prior art foot switches. Further, as a result of the dentist's heel being positioned on the heel support, a substantial downward pressure is exerted on the base plate by the weight of the dentist's leg. As a result, the base plate and, correspondingly, the switches mounted thereon remain in the desired position. Further, having the foot resting comfortably on the heel while the toes are in a position in which slight movement will allow them to activate the switches on the base plate eliminates the need for the dentist to make visual contact with the foot control unit in order to realign the foot with a switch of the foot control unit and also eliminates any associated peripheral body movement.

In one exemplary embodiment, a pair of switches is positioned on the base plate. Each of the pair of switches may be inclined relative to the base plate. For example, the lateral side of each of the pair of switches may be elevated relative to both the base plate and the corresponding medial side of each switch. By elevating the lateral sides of the switches relative to both the medial sides of the switches and the base plate upon which the switches are positioned, the switches may be placed substantially adjacent one another and the dentist's foot may be utilized to actuate either of the switches without substantially simultaneously depressing both switches. Thus, the dentist may depress a corner of the medial side of either of the switches without unintentionally depressing a portion of the adjacent switch. This allows for each of the switches to be depressed with substantially minimum muscular-skeletal activity in the foot and leg and, correspondingly, substantially minimum subsequent body movement during a dental procedure.

Alternatively, in another exemplary embodiment, the medial side of each of the pair of switches is elevated relative to both the base plate and the corresponding lateral side of each of the pair of switches. This provides a substantially similar benefit as described above with respect to elevating the lateral side of each of the pair of switches. In another exemplary embodiment, one of the pair of switches is located further forward, i.e., further anterior in relation to the user's body, relative to the position of the other switch to better correspond to the position and the actuation movement of the foot.

Additionally, in one exemplary embodiment, each of the switches of the present foot control unit is utilized to control multiple functions of a dental instrument or different functions of different dental instruments. For example, in one exemplary embodiment, depressing one of a pair of switches once, i.e., single clicking, causes the switch to adjust one function of a dental instrument. However, depressing the same switch twice in rapid succession, i.e., double clicking, causes the switch to adjust a second function of a dental instrument or, alternatively, adjust the function of a second dental instrument. Thus, one of the switches may control both the focus of a dental camera system and the zoom of a dental camera system, for example. In another exemplary embodiment, the foot control unit can contain a third switch that can be activated by the heel of a user's foot to switch between two different operations, such as automatic focus and manual focus.

In one form thereof, the present invention provides a foot control unit for use by an operator to control the function of an instrument, the foot control unit including: a base plate having a longitudinal axis, an anterior end, and a posterior end; a heel support connected to the base plate and extending upwardly therefrom, the heel support having an upper surface upon which a heel of the operator is supported, the upper surface of the heel support being spaced from the base plate by a heel support distance; a first switch connected to the base plate, wherein at least a portion of the first switch is positioned on the base plate between the heel support and the anterior end of the base plate, the first switch having an upper surface spaced from the base plate by a first switch distance; and a second switch connected to the base plate, wherein at least a portion of the second switch is positioned on the base plate between the heel support and the anterior end of the base plate, the second switch having an upper surface spaced from the base plate by a second switch distance, wherein the heel support distance is greater than both of the first switch distance and the second switch distance.

In another form thereof, the present invention provides a foot control unit for use by an operator to control the function of an instrument, the foot control unit including: a base plate having a posterior end and an opposing anterior end; a heel support rotatably connected to the base plate adjacent to the posterior end of the base plate, the heel support having an upper surface upon which a heel of the operator is supported, the upper surface defining an angle relative to the base plate, the upper surface angling downwardly in the direction of the anterior end of the base plate, whereby, with the heel of the operator positioned on the upper surface of the heel support, the toes of the operator are positioned below the upper surface of the heel support in a substantially natural muscular-skeletal position; and a switch connected to the base plate, wherein at least a portion of the switch is positioned on the base plate between the heel support and the anterior end of the base plate.

In yet another form thereof, the present invention provides a foot control unit for use by an operator to control the function of an instrument, the foot control unit including: a base plate having a longitudinal axis; a heel support connected to the base plate and extending upwardly therefrom, the heel support having an upper surface upon which a heel of the operator is supported; a first switch connected to the base plate, the first switch having a medial edge and a lateral edge, the first switch having an upper surface defining a first angle relative to the base plate in a plane perpendicular to the longitudinal axis of the base plate, wherein the lateral edge of the first switch is spaced from the base plate by a greater distance than the medial edge of the first switch; and a second switch connected to the base plate, the second switch having a medial edge and a lateral edge, the second switch having an upper surface defining a second angle relative to the base plate in a plane perpendicular to the longitudinal axis of the base plate, wherein the lateral edge of the second switch is spaced from the base plate by a greater distance than the medial edge of the second switch.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
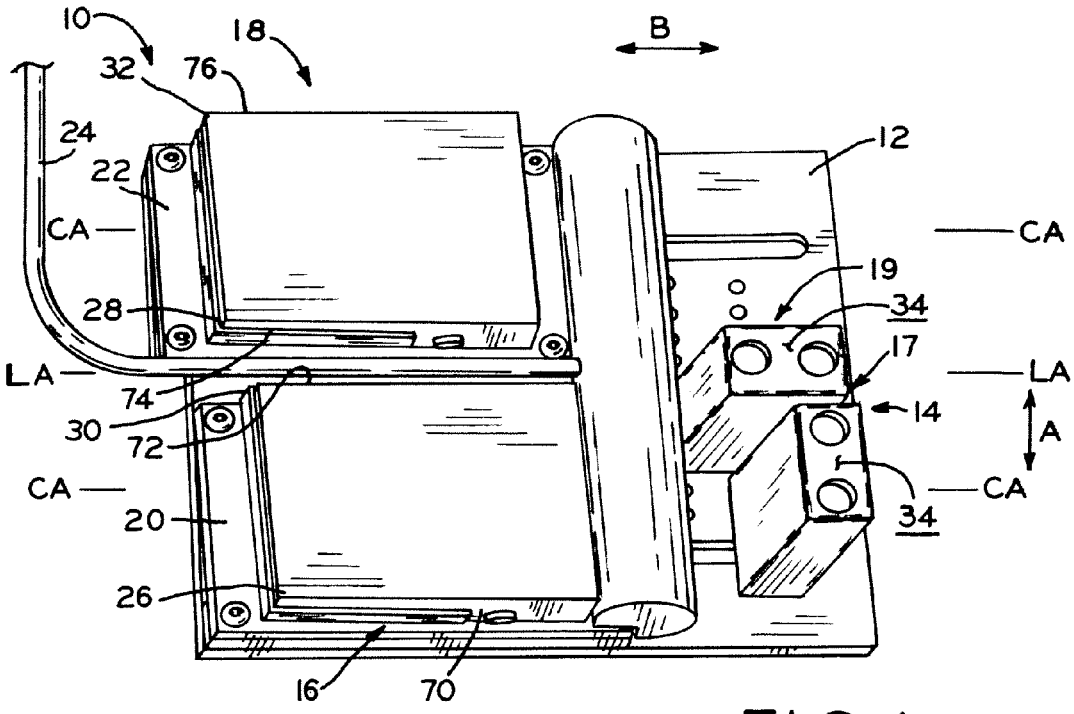
FIG. 1 is a top, perspective view of an exemplary embodiment of the foot control unit of the present invention configured for use with a left foot.

Referring to FIG. 1, foot control unit 10 of the present invention is shown. Foot control unit 10 includes base plate 12 having heel support 14 secured thereto and switches 16, 18 positioned thereon. Heel support 14 extends upward from base plate 12 and is designed to support the heel of a dentist's foot during a dental procedure, as described in detail below. While described in detail herein with specific reference to use by a dentist during a dental procedure, foot control unit 10 may be used by any individual and in any situation in which the foot operated control of instruments and/or machinery is desirable, such as by a surgeon or a musician. Additionally, while described and depicted herein with specific reference to two switches, i.e., switches 16, 18, the present invention may be utilized in conjunction with any number of switches. In one exemplary embodiment, switches 16, 18, are "Treadlight" switches commercially available from LINEMASTER Switch Corporation, 29 Plaine Hill Road, P.O. Box 238, Woodstock, Conn. 06281-0238.

Figure 2:
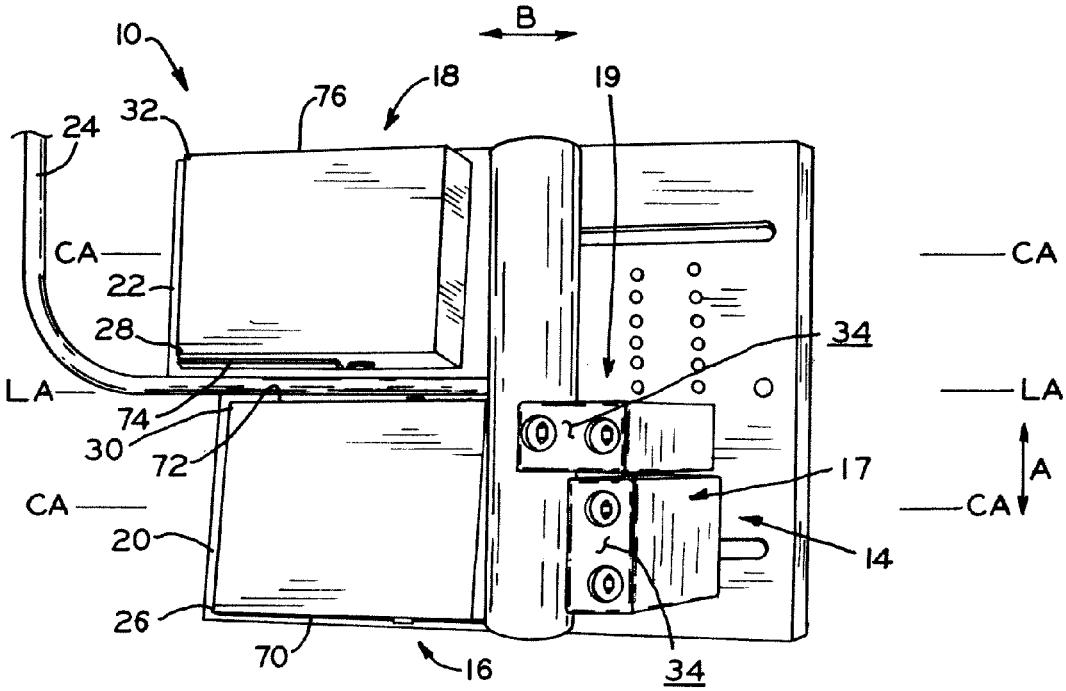
FIG. 2 is another top, perspective view of the foot control unit of FIG. 1.
Figure 3:
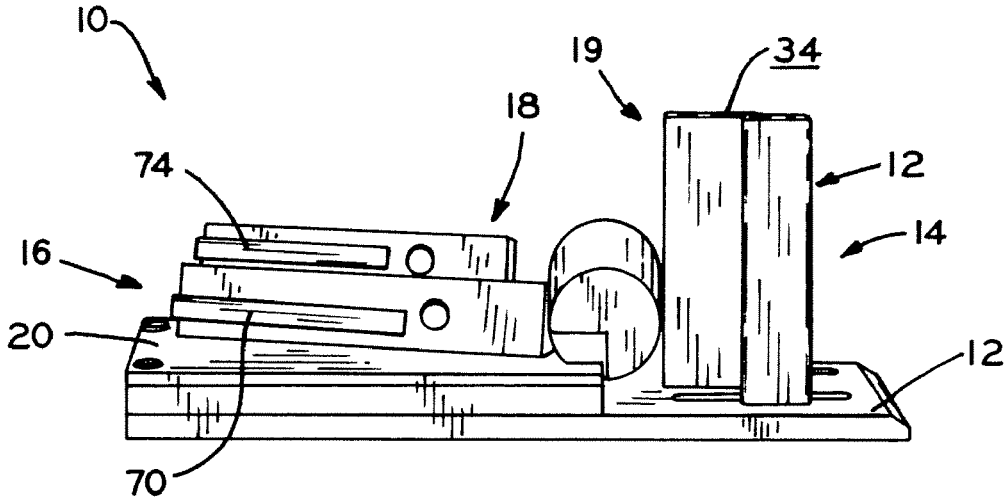
FIG. 3 is a lateral, perspective view of the foot control unit of FIG. 1.
Figure 4:
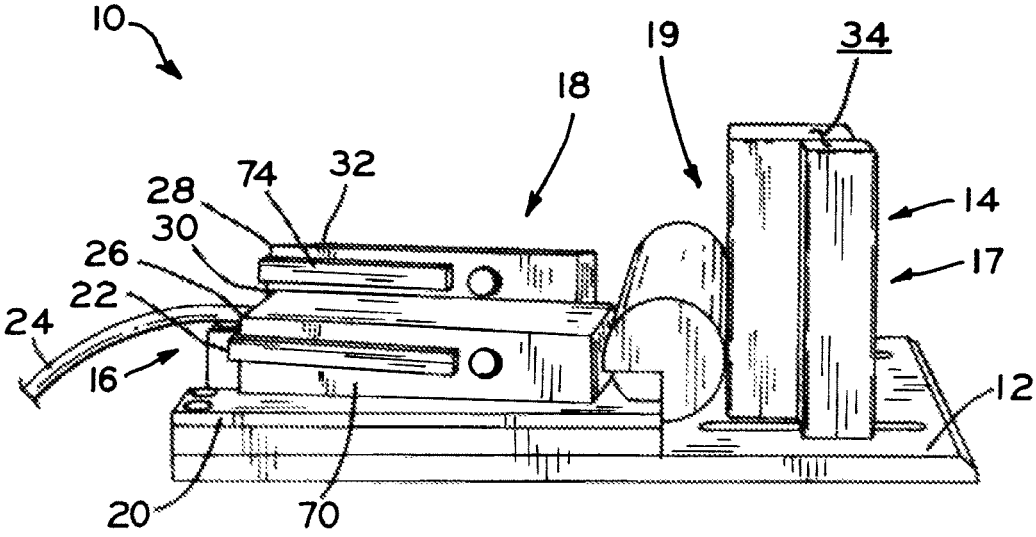
FIG. 4 is another lateral, perspective view of the foot control unit of FIG. 1.
Figure 5:
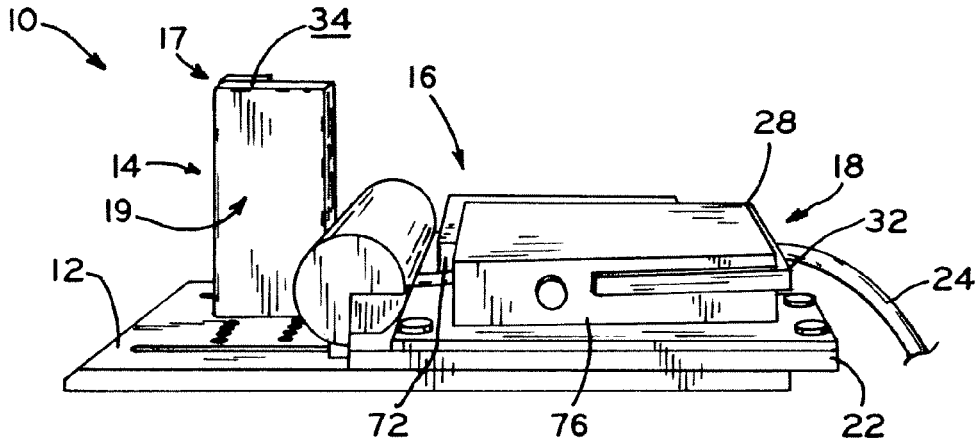
FIG. 5 is a medial, perspective view of the foot control unit of FIG. 1.

Referring to FIGS. 1 and 2, heel support 14 forms an L-shaped body having L-base 17, i.e., the longer portion of the L-shaped body, extending in a medial-lateral direction with respect to the dentist's foot, i.e., in the direction of arrows A of FIGS. 1 and 2, and L-projection 19, i.e., the shorter portion of the L-shaped body, extending from the medial side of L-base 17 in a generally anterior-posterior direction with respect to the dentist's foot, i.e., in the direction of arrows B of FIGS. 1 and 2. As shown, L-projection 19 is positioned adjacent to longitudinal axis LA of base plate 12 and extends in a direction substantially parallel to longitudinal axis LA. While depicted herein as being formed from two individual components, each individually secured to base plate 12, heel support 14 may be formed as a monolithic, i.e., single piece, component.

Figure 6:
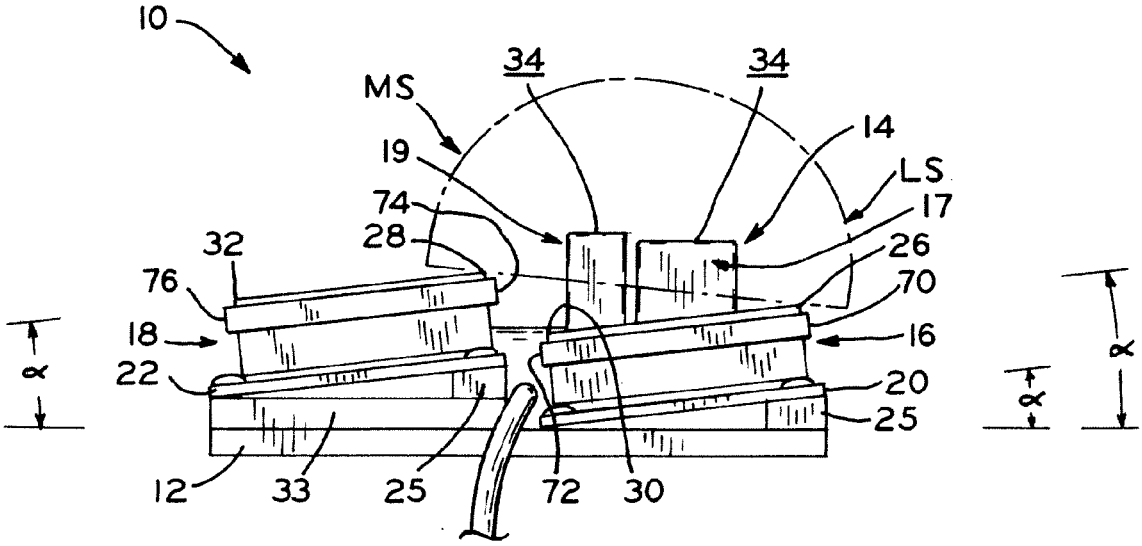
FIG. 6 is a front, perspective view of the foot control unit of FIG. 1 further depicting an operator's foot in dashed lines.

By forming heel support 14 as an L-shaped body, a dentist's left heel may be positioned on top surface 34 of heel support 14 and, due to the additional support provided by L-projection 19 on the medial side of the dentist's heel, the dentist's foot may be tilted as shown in dashed lines in FIG. 6. Specifically, as shown in FIG. 6, the medial side MS of the dentist's foot is positioned at a distance spaced further from base plate 12 than the lateral side LS of the dentist's foot. This allows for the dentist's to use minimal movement to actuate switches 16, 18, as described in detail below. Additionally, while described and depicted as forming an L-shaped body having an L-base and an L-projection of differing lengths, the lengths of the L-base and L-projection may be substantially equal to one another. Further, heel support 14 may take any shape and is not limited to the L-shaped body described herein.

Figure 7:
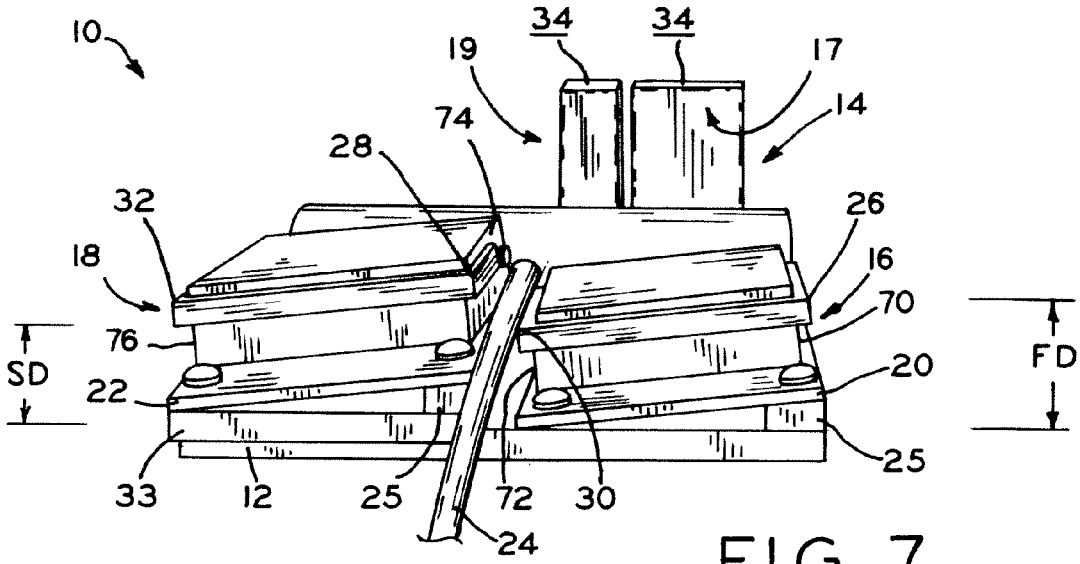
FIG. 7 is another front, perspective view of the foot control unit of FIG. 1.

Referring to FIGS. 6 and 7, switches 16, 18 are positioned atop supports 20, 22, respectively, and spaced anteriorly from heel support 14, as described in detail below. Referring to FIG. 1, switches 16, 18 are positioned on opposing sides of longitudinal axis LA of base plate 12. In one exemplary embodiment, each of switches 16, 18 includes central axes CA, which, in one exemplary embodiment, define longitudinal axes of switches 16, 18, that extend through a central portion of switches 16, 18. In one exemplary embodiment, central axes CA are substantially parallel to longitudinal axis LA of base plate 12. Medial sides 70, 74 and lateral sides 72, 76 of switches 16, 18, respectively, are positioned on opposing sides of central axis CA and, in one exemplary embodiment, define corners 26, 28, 30, 32 of switches 16, 18, respectively.

Supports 20, 22, upon which switches 16, 18 are supported, are secured to base plate 12 using suitable fasteners, such as screws. Referring to FIGS. 6 and 7, supports 20, 22 are inclined relative to base plate 12. For example, a first side of supports 20, 22 may be secured directly to base plate 12 and a second, opposing side of supports 20, 22 may be secured to base plate 12 via spacers 25. As shown, spacers 25 are positioned between supports 20, 22 and base plate 12 to elevate a lateral side of each of supports 20, 22. Specifically, referring to FIG. 6, supports 20, 22, form angles of inclination a relative to base plate 12. Thus, with switches 16, 18 positioned flat atop supports 20, 22, respectively, switches 16, 18 also define angles of inclination $\alpha$ in a plane perpendicular to longitudinal axis LA of base plate 12. In one exemplary embodiment, angles of inclination $\alpha$ are between 5 degrees and 30 degrees. For example, angles of inclination $\alpha$ may be as small as approximately 5 degrees, 10 degrees, or 15 degrees and as large as approximately 20 degrees, 25 degrees, or 30 degrees.

As shown in FIG. 6, angles of inclination α of switches 16, 18 are substantially equal. However, in other exemplary embodiments, switches 16, 18 may have angles of inclination α that are substantially different from one another to correspond to the medial-lateral tilt of the dentist's foot while resting on heel support 14, as described in detail above. Advantageously, by positioning switches 16, 18, in an inclined position, a dentist may actuate one of switches 16, 18 using minimal foot movement without inadvertently actuating the other of switches 16, 18, as described in detail below.

Specifically, by placing the dentist's foot in contact with one of corners 26, 28 of switches 16, 18, respectively, the dentist may actuate one of switches 16, 18 by depressing the same downward, i.e., substantially in the direction of base plate 12. As the one of switches 16, 18 is depressed, the dentist's foot will correspondingly move downward but, due to the recessed position of corners 30, 32 of switches 16, 18 that results from the angle of inclination α of switches 16, 18, the dentist is unlikely to inadvertently depress the other of switches 16, 18. Stated another way with reference to FIG. 7, corners 26, 28 of switches 16, 18 are spaced from base plate 12 by first distances FD, while corners 30, 32 of switches 16, 18 are spaced from base plate 12 by second distances SD, which is substantially less than first distances FD. As a result, even if one of corners 26, 28 of switches 16, 18 is depressed to its maximum extent, the dentist's foot does not advance far enough toward base plate 12 to inadvertently contact one of corners 30, 32 of the other of switches 16, 18.

Additionally, in another exemplary embodiment shown in FIGS. 6 and 7, support 22 may be positioned atop an additional spacer 33. The use of spacer 33 results in support 22 and switch 18 being elevated to a greater height above base plate 12 than support 20 and switch 16. This increased height of support 22 and switch 18 adds an additional distance that the foot of a dentist must travel in the direction of base plate 12 when depressing corner 28 of switch 18 before inadvertently contacting switch 16. In addition, this difference in height between switches 16, 18 also compensates for the medial-lateral tilt of the dentist's foot created by heel support 14, which is used to place the dentist foot in a more natural muscular-skeletal position.

Further, as shown in FIGS. 1 and 2, switch 18 may be positioned further forward or anterior on base plate 12 than switch 16. By positioning switch 18 further forward on base plate 12 than switch 16, the dentist is able to rock the foot about the heel in a substantially natural manner and easily depress corners 26, 28 of switches 16, 18. For example, when used with the dentist's left foot, the dentist may rotate or tilt their foot to the right and depress corner 28 of switch 18 with the toes. Alternatively, the dentist may rotate the foot to the left and depress corner 26 of switch 16 with the lateral edge of the ball of the foot. As described and depicted herein, foot control unit 10 is configured for use by the dentist's left foot. However, foot control unit 10 may be adapted for use with a dentist's right foot by utilizing the teachings provided herein to reverse the orientation of switches 16, 18 and to position heel support 14 on the right side of base plate 12 to maintain the position of heel support 14 on the lateral side of base plate 12.

In one exemplary embodiment, switches 16, 18 are electronically connected to a dental instrument or a dental instrument controller, such as a microprocessor, by cable 24. Thus, when one of switches 16, 18 is depressed, an electronic signal is transmitted from the one of switches 16, 18 through cable 24. The electronic signal is then transferred via cable 24 to the dental instrument or dental instrument controller, which is configured to corresponding alter the function of a dental instrument in response to the electronic signal. For example, in one exemplary embodiment, switches 16, 18 are connected to an operating microscope. In this embodiment, switches 16, 18 may be depressed to control the zoom and/or focus of the operating microscope. In one embodiment, the operating microscope is a 3D stereoscopic camera system, such as the type disclosed in copending U.S. patent application Ser. No. 12/119,027, entitled STEREOSCOPIC THREE DIMENSIONAL VISUALIZATION SYSTEM AND METHOD OF USE, filed on May 12, 2008, the entire disclosure of which is expressly incorporated by reference herein.

Additionally, when one of switches 16, 18 is depressed, the electronic signal sent to the dental instrument or dental instrument controller may provide a fixed result, i.e., the function of the dental instrument is changed at a predetermined speed and/or rate, or, alternatively, the electronic signal sent to the dental instrument or dental instrument controller may provide a proportional result, i.e., the amount of pressure placed on switch 16, 18 directly corresponds to the electronic signal provided to the dental instrument and allows the dentist to adjust the speed and/or rate at which the function controlled by switches 16, 18 is altered by increasing or decreasing the pressure applied.

In one exemplary embodiment, switches 16, 18 may be configured so that each of switches 16, 18 controls two distinct functions of a dental instrument. For example, by depressing one of switches 16, 18 once, i.e., single clicking, a first function of a dental instrument is controlled. Alternatively, by depressing one of switches 16, 18 twice in rapid succession, i.e., double clicking, a second function of a dental instrument is controlled. For example, the dentist may depress corner 26 of switch 16 once, i.e., single click, to cause the focus of the above-identified camera system to be adjusted in a first direction and may depress corner 28 of switch 18 once to cause the focus of the above-identified camera system to be adjusted in a second, opposite direction. Additionally, the dentist may depress corner 26 of switch 16 twice in rapid succession, i.e., double clicking, to cause the zoom of the above-identified camera system to be adjusted in a first direction and may depress corner 28 of switch 18 twice in rapid succession, i.e., double clicking, to cause the zoom of the above-identified camera system to be adjusted in a second, opposite direction. Thus, by utilizing both a single click and a double click control technique, the dual switch system according to an embodiment of the present invention may be utilized to control multiple functions of a single dental instrument or individual functions of different dental instruments.

As described briefly above, in order to operate foot control unit 10, a dentist places the heel of their foot upon heel support 14 and allows their toes and ball of the foot to hang downward so that the toes are positioned below the heel of the foot. This places the foot in a downwardly sloped angle that is substantially similar to the position the foot may be in when the heel is placed on the rail of a chair, for example. Additionally, in exemplary embodiments, this allows for the dentist's leg to form an angle of less than ninety degrees between the tibia and femur. By placing the foot in this position, the foot is in a neutral muscular-skeletal position that helps eliminate the stress and strain placed on the foot during the use of foot control unit 10. As a result, the fatigue and pain that may be experienced by a dentist when utilizing a foot control unit is substantially eliminated by the use of foot control unit 10.

Additionally, by positioning the heel of the foot on heel support 14, a substantial amount of pressure is applied to base plate 12 by the weight of the dentist's leg being support on heel support 14. As a result of this pressure, base plate 12 and, correspondingly, switches 16, 18 are maintained in substantially the same position throughout the dental procedure. This eliminates the need for the dentist to make visual contact with foot control unit 10 during the dental procedure in order to realign the foot with the same. Additionally, in another exemplary embodiment, heel support 14 includes top surface 34 that is chamfered (not shown) in the direction of switches 16, 18. As a result of the chamfering of top surface 34, the dentist's foot is more easily rotated downward from a neutral muscular-skeletal position to activate either switch, as described in detail above.

With the dentist's left heel supported on heel support 14, the dentist may simply rock the foot to a medial position by pivoting it about heel support 14 to depress corner 28 of switch 18 or, alternatively, may rock the foot to a lateral position by pivoting it about heel support 14 to depress corner 26 of switch 16. This allows the dentist to actuate switches 16, 18 with minimal foot and leg movement. As a result, the upper portion the dentist's body remains in substantially the same position, which allows the dentist to continue performing a dental procedure without the need to remove their hands and/or dental instruments for the patient's oral cavity.

In another exemplary embodiment of the present invention, side plates (not shown) may be added to base plate 12 that extend upward beyond switches 16, 18 at the lateral and medial sides of switches 16, 18, respectively. These side plates may also incorporate a switch therein or otherwise have a switch positioned thereon. As a result, by pivoting the dentist's foot about heel support 14 to extend beyond one of switches 16, 18, the outer edges of the dentist's foot may contact one of the side plates to depress a switch. In one exemplary embodiment, the switches used in conjunction with the side plates are substantially similar to switches 16, 18. This allows the dentist to control additional functions of the dental instrument or, alternatively, other dental instruments. Further, the side switches may also employ both a single click and a double click control, as described in detail above with respect to switches 16, 18.

In another exemplary embodiment, switches 16, 18, are replaced by optical beams. In this embodiment, when the foot of the dentist breaks the optical beams, an electronic signal is sent to the dental instrument or dental instrument controller to correspondingly alter the function of the dental instrument. Thus, instead of the depression of a switch, such as switches 16, 18, controlling the function of the dental instrument, the breaking of a light beam would correspondingly control similar functions.

Figure 8:
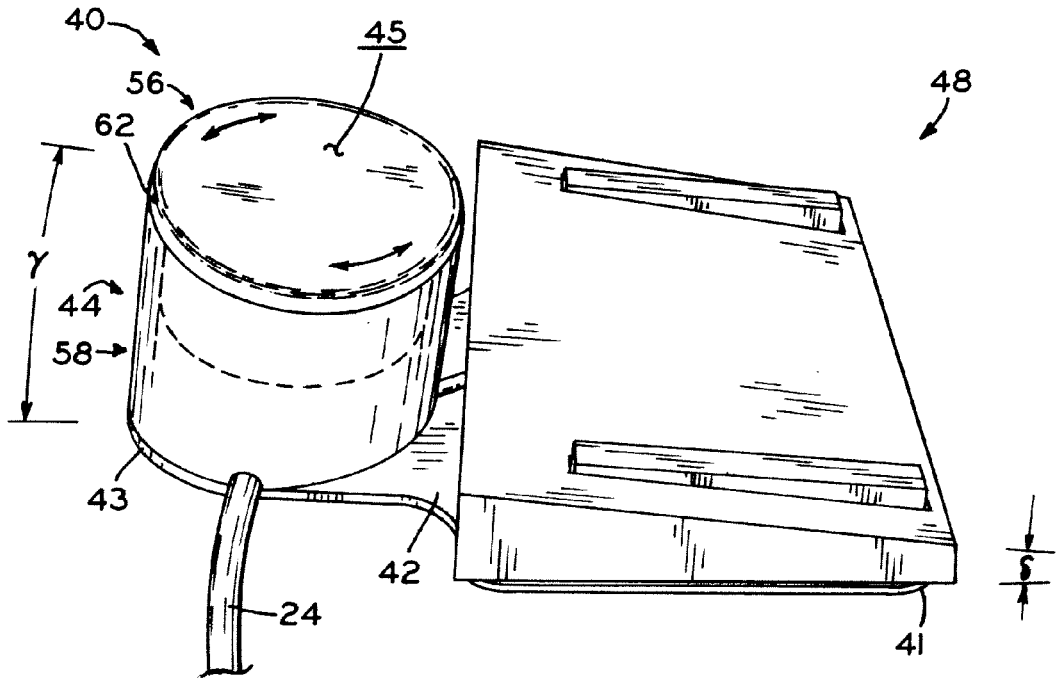
FIG. 8 is a perspective view of a foot control unit according to another exemplary embodiment.
Figure 9:
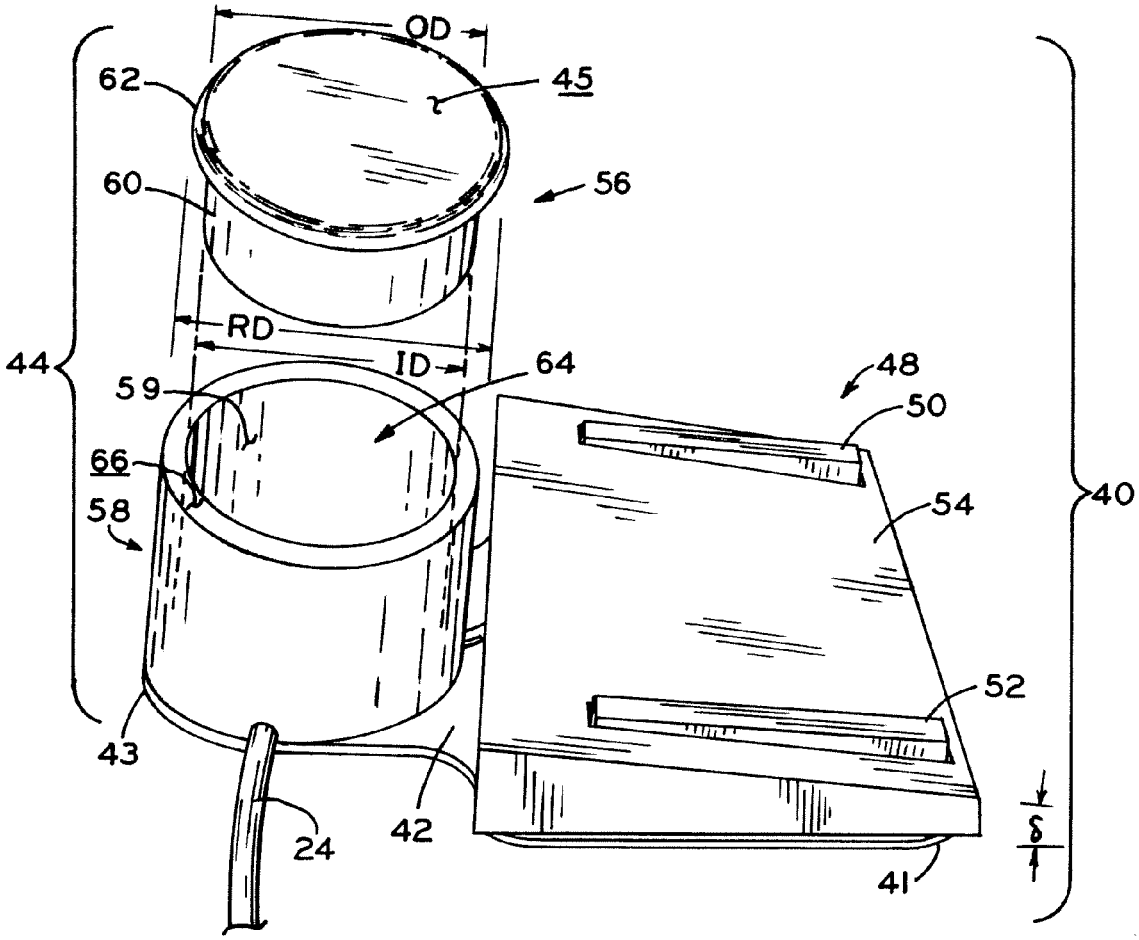
FIG. 9 is an exploded view of the heel support of the foot control unit of FIG. 8.

Referring to FIGS. 8 and 9, another exemplary embodiment of a foot control unit is shown generally at numeral 40. Foot control unit 40 provides many of the same benefits as foot control unit 10, which are described in detail above. Foot control unit 40 includes base plate 42, heel support 44 secured thereto, and switch system 48 positioned thereon. Base plate 42 includes an anterior end 41 and an opposing posterior end 43. Heel support 44 is secured to base plate 42 adjacent to posterior end 43 thereof. Heel support 44 extends upwardly from base plate 42 and is designed to support the heel of a dentist's foot during a dental procedure, in a similar described in detail above with respect to heel support 14 of foot control unit 10. In one exemplary embodiment, heel support 44 is adjustable, such that the distance between base plate 42 and top surface 45 of heel support 44 may be altered. For example, it may be desirable to adjust the distance between base plate 42 and top surface 45 to compensate for the size of the sole and/or heel portion of a dentist's shoe. For example, it may be advantageous to decrease the distance between base plate 42 and top surface 45 if a dentist is wearing high heels. Alternatively, it may be advantageous to increase the distance between base plate 42 and top surface 45 if a dentist is wearing a thin sole shoe. In a similar manner as described above with respect to heel support 44, heel support 14 of foot control unit 10 may also be adjustable, such that the distance between base plate 12 and top surface 34 of heel support 14 may be correspondingly increased and/or decreased.

Heel support 44 is inclined in a downward direction extending toward the front of base plate 42 and switch system 48, resulting in the creation of angle γ between top surface 45 of heel support 44 and base plate 12. In one exemplary embodiment, angle γ is between 5 degrees and 30 degrees. For example, angle γ may be as small as approximately 5 degrees, 10 degrees, or 15 degrees and as large as approximately 20 degrees, 25 degrees, or 30 degrees. By positioning heel support 44 in this inclined position, heel support 44 positions the foot at a corresponding downwardly sloped angle that provides a neutral muscular-skeletal position to help eliminate stress and strain placed on the foot during the use of the foot control unit 40.

Additionally, in one exemplary embodiment, heel support 44 includes rotatable upper support 56 and annular base 58. Referring to FIG. 9, upper support 56 includes body 60 having annular rim portion 62 extending radially outwardly from one end thereof. Body 60 has an outer diameter OD sized for receipt within opening 64 defined in annular base 58. Additionally, annular rim portion 62 has a rim diameter RD that is greater than outer diameter OD of body 60. Turning to annular base 58, annular base 58 forms a substantially ring shaped body that includes inner wall 59 that defines opening 64 and has inner diameter ID.

In one exemplary embodiment, outer diameter OD of body 60 of upper support 56 is less than inner diameter ID of opening 64 defined by wall 59 and rim diameter RD of annular rim portion 62 is greater than inner diameter ID of opening 64 defined by wall 59. Thus, with body 60 of upper support 56 received within opening 64 of annular base 58, annular rim portion 62 of body 60 is supported on top surface 66 of annular base 58. Additionally, in this position, upper support 56 may be rotated within opening 64 to allow upper support 56 and, correspondingly, a dentist's foot positioned thereon, to be rotated relative to annular base 58, base plate 42, and switch system 48 secured to base plate 42. In one exemplary embodiment, upper support 56 is formed from an acetal resin, such as Delrin® acetal resin, commercially available from E.I. du Pont de Nemours and Company of Wilmington, Del. Delrin® is a registered trademark of E.I. du Pont de Nemours and Company. Acetal resin provides a low friction bearing surface that allows for the smooth rotation of upper support 56 relative to annular base 58 and base plate 42.

With the dentist's heel positioned on top surface 45 of heel support 44, the dentist may move their foot to activate a switch, such as a switch included in switch system 48, positioned on base plate 42. In one exemplary embodiment, switch system 48 is a model number 68-S3, Deluxe II foot switch, which is commercially available from LINEMASTER Switch Corporation. In one exemplary embodiment, switch system 48 includes medial and lateral switches 50, 52 and center switch 54. Switch system 48 is also inclined in a downward direction extending toward anterior end 43 of base plate 42, resulting in the creation of angle δ between upper surface 55 of center switch 54 of switch system 48 and base plate 42. In one exemplary embodiment, angle δ is substantially equal to angle γ between top surface 45 of heel support 44 and base plate 12. In one exemplary embodiment, angle δ is between 5 degrees and 30 degrees. For example, angle δ may be as small as approximately 5 degrees, 10 degrees, or 15 degrees and as large as approximately 20 degrees, 25 degrees, or 30 degrees. By depressing any of switches 50, 52, 54, the operation of a dental instrument may be controlled in a similar manner as described above with respect to foot control unit 10. Additionally, in a similar manner as switches 16, 18 of foot control unit 10, switches 50, 52, 54 may be utilized to control two or more distinct functions of a dental instrument. For example, by depressing one of switches 50, 52, 54 once, i.e., a single clicking, a first function of a dental instrument may be controlled. Alternatively, by depressing one of switches 50, 52, 54 twice in rapid succession, i.e., double clicking, a second function of a dental instrument may be controlled.

In one exemplary embodiment, foot control unit 40 is configured to operate a 3D stereoscopic camera system, such as the type disclosed in copending U.S. patent application Ser. No. 12/119,027, entitled STEREOSCOPIC THREE DIMENSIONAL VISUALIZATION SYSTEM AND METHOD OF USE, the entire disclosure of which is incorporated herein above. For example, by single clicking one of switches 50, 52, an incremental focusing function of the camera system will be performed. In one exemplary embodiment, single clicking switch 50 will result in the camera system incrementally adjusting the focus in a first direction, while single clicking switch 52 will result in the camera system incrementally adjusting the focus in a second, opposite direction. Then, by double clicking one of switches 50, 52, a zooming function of the camera system will be performed. In one exemplary embodiment, double clicking switch 50 will result in the camera system zooming out, while double clicking switch 52 will result in the camera system zooming in.

Additionally, in this embodiment, center switch 54 may be clicked and held for a predetermined period of time, such as two seconds, to place the camera system into manual focus at infinity. The infinity position is very useful as a repeatable homing position for best stereoscopic visual performance (focus and parallax) of the camera system. Center switch 54 may then be clicked a second time to return the camera system to an auto focus mode. Further, center switch 54 may be single clicked without being held down for a predetermined period of time to set the camera system to manual focus mode at the same focal distance that the auto focus was set at when center switch 54 was clicked.

Advantageously, by utilizing heel support 44 in conjunction with switch system 48, switch system 48 can be utilized by pressing any of switches 50, 52, 54 downwardly with minimal physical effort. Additionally, the design of the present invention allows for a constant and comfortable position of the foot that includes full heel support at rest, which prevents fatigue as described in detail above. Additionally, heel support 44 allows a user to maintain their foot at a consistent distance above switch system 48. As a result, the user may quickly memorize the location of each switch which allows the user to activate the same without looking at switch system 48 to determine an individual switch's location. This eliminates a potential interruption in the work flow of the dentist. Additionally, the inclined position of heel support 44 allows for a smooth operation of the foot switch that minimizes collateral foot, leg, and body movement, which is otherwise disruptive to a microscopic-type procedure.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A foot control unit for use by an operator to control the function of an instrument, the foot control unit comprising:

a base plate having a longitudinal axis;

a heel support connected to said base plate and extending upwardly therefrom, said heel support having an upper surface upon which a heel of the operator is supported;

a first switch connected to said base plate, said first switch having a medial edge and a lateral edge, said first switch having an upper surface defining a first angle relative to said base plate in a plane perpendicular to said longitudinal axis of said base plate, wherein said lateral edge of said first switch is spaced from said base plate by a greater distance than said medial edge of said first switch; and a second switch connected to said base plate, said second switch having a medial edge and a lateral edge, said second switch having an upper surface defining a second angle relative to said base plate in a plane perpendicular to said longitudinal axis of said base plate, wherein said lateral edge of said second switch is spaced from said base plate by a greater distance than said medial edge of said second switch.

2. The foot control unit of claim 1, wherein said medial edge of said first switch is spaced from said base plate by a first distance and said medial edge of said second switch is spaced from said base plate by a second distance, said first distance being greater than said second distance.

3. The foot control unit of claim 1, wherein said upper surface of said heel support is spaced a greater distance from said base plate than either of said upper surface of said first switch and said upper surface of said second switch, whereby, with the heel of the operator positioned on said upper surface of said heel support, the toes of the operator are positioned below the upper surface of the heel support in a substantially natural muscular-skeletal position.

4. The foot control unit of claim 1, wherein said first angle is substantially equal to said second angle.

5. The foot control unit of claim 1, wherein said first angle is different than said second angle.

6. The foot control unit of claim 1, wherein said heel support is substantially L-shaped, said heel support having an L-base extending in a direction substantially perpendicular to said longitudinal axis of said base plate and an L-projection extending in a direction substantially parallel to said longitudinal axis of said base plate.

7. The foot control unit of claim 6, wherein said L-projection is positioned adjacent to said longitudinal axis of said base plate, whereby, with the heel of the operator positioned on said upper surface of said heel support, the foot of the operator is tilted in a medial-lateral direction substantially perpendicular to a longitudinal axis of the foot of the operator.

8. The foot control unit of claim 1, wherein said medial edge and said lateral edge of said first switch define a medial corner and a lateral corner of said first switch and said medial edge and said lateral edge of said second switch define a medial corner and a lateral corner of said second switch.

9. A foot control unit for use by an operator to control the function of an instrument, the foot control unit comprising:

a base plate having a posterior end and an opposing anterior end;

a heel support rotatably connected to said base plate adjacent to said posterior end of said base plate, said heel support having an upper surface upon which a heel of the operator is supported, said upper surface defining an angle relative to said base plate, said upper surface angling downwardly in the direction of said anterior end of said base plate, whereby, with the heel of the operator positioned on said upper surface of said heel support, the toes of the operator are positioned below the upper surface of the heel support in a substantially natural muscular-skeletal position; and a switch connected to said base plate, wherein at least a portion of said switch is positioned on said base plate between said heel support and said anterior end of said base plate.

10. The foot control unit of claim 9, wherein said heel support comprises an upper support and a base, said upper support having a body and an annular rim portion, said annular rim portion defining said upper surface of said heel support, said upper support rotatably connected to said base.

11. The foot control unit of claim 10, wherein said base comprises an annular base having a top surface and an inner wall defining an opening having an inner diameter, said annular rim portion of said upper support having a rim diameter, said rim diameter being greater than said inner diameter of said opening of said annular base, said body of said upper support sized for receipt within said opening of said annular base, wherein said annular rim portion of said upper support is supported on said top surface of said annular base.

12. The foot control unit of claim 11, wherein said top surface of said annular base defines a top surface angle relative to said base plate, said top surface angle being substantially equal to said angle defined by said upper surface of said annular rim portion.

13. The foot control unit of claim 11, wherein said body of said upper support has an outer diameter, said outer diameter being less than said inner diameter of said annular base, wherein, with said body of said upper support received within said opening in said annular base, and said upper support is rotatable relative to said annular base.

14. The foot control unit of claim 12, wherein said top surface of said annular base defines a top surface angle relative to said base plate, said top surface angle being substantially equal to said angle defined by said upper surface of said annular rim portion.

15. The foot control unit of claim 9, wherein said switch comprises a central switch formed as an inclined plate, said inclined plate defining a switch angle with said base plate, wherein said inclined plate is angled downwardly in the direction of said anterior end of said base plate.

16. A foot control unit for use by an operator to control the function of an instrument, the foot control unit comprising:

a base plate having a longitudinal axis, an anterior end, and a posterior end;

a heel support connected to said base plate and extending upwardly therefrom, said heel support having an upper surface upon which a heel of the operator is supported, said upper surface of said heel support being spaced from said base plate by a heel support distance;

a first switch connected to said base plate, wherein at least a portion of said first switch is positioned on said base plate between said heel support and said anterior end of said base plate, said first switch having an upper surface spaced from said base plate by a first switch distance; and a second switch connected to said base plate, wherein at least a portion of said second switch is positioned on said base plate between said heel support and said anterior end of said base plate, said second switch having an upper surface spaced from said base plate by a second switch distance, wherein said heel support distance is greater than both of said first switch distance and said second switch distance.

17. The foot control unit of claim 16, wherein said upper surface of said first switch defines a first angle relative to said base plate in a plane perpendicular to said longitudinal axis of said base plate and said upper surface of said second switch defines a second angle relative to said base plate in a plane perpendicular to said longitudinal axis of said base plate.

18. The foot control unit of claim 16, wherein said first angle is greater than said second angle.

19. The foot control unit of claim 16, wherein said upper surface of said heel support defines an angle relative to said base plate, said upper surface angling downwardly in the direction of said anterior end of said base plate, whereby, with the heel of the operator positioned on said upper surface of said heel support, the toes of the operator are positioned below the upper surface of the heel support in a substantially natural muscular-skeletal position.

20. The foot control unit of claim 16, wherein said upper surface of said heel support defines a heel support angle relative to said base plate in a plane perpendicular to said longitudinal axis of said base plate.

* * * * *